United States Patent [19]

Holstensson

[11] Patent Number: 4,838,510

[45] Date of Patent: Jun. 13, 1989

[54] SEAT MOUNTING FOR OFFICE CHAIRS

[76] Inventor: Lars A. Holstensson, Södra Koltorpsgatan 37, S-571 00, Nässj/e,uml/o/ , Sweden

[21] Appl. No.: 98,083

[22] Filed: Sep. 21, 1987

[51] Int. Cl.[4] ..... A47C 1/024

[52] U.S. Cl. ..... 248/397; 248/576; 297/300

[58] Field of Search ..... 248/397, 398, 396, 371, 248/372.1, 576, 575, 162.1; 297/355, 327, 328, 300, 301

[56] References Cited

U.S. PATENT DOCUMENTS

| | | | |
|---|---|---|---|
| 4,364,605 | 12/1982 | Meiller | 297/300 X |
| 4,471,994 | 9/1984 | Zund et al. | 297/355 X |
| 4,521,053 | 6/1985 | de Boer | 297/355 X |
| 4,589,697 | 5/1986 | Bauer et al. | 297/300 |
| 4,603,905 | 8/1986 | Stucki | 297/300 |

FOREIGN PATENT DOCUMENTS

| | | | |
|---|---|---|---|
| 2757349 | 12/1977 | Fed. Rep. of Germany | 297/355 |
| 2846360 | 5/1980 | Fed. Rep. of Germany | 297/300 |
| 2855915 | 6/1980 | Fed. Rep. of Germany | 297/300 |
| 2571005 | 4/1986 | France | 297/300 |

*Primary Examiner*—Robert W. Gibson, Jr.
*Assistant Examiner*—Karen J. Chotkowski
*Attorney, Agent, or Firm*—Marshall & Melhorn

[57] ABSTRACT

Seat mounting, especially for office chairs, having a frame attachable to the lower side of the chair and provided with a pivotal holder for the back-rest and a pivotal holder for the support column of the chair. Secured between said holders and said frame are gas springs counteracting pivotal movement of said holders and, when actuated, permitting said holders to be pivoted. To actuate said gas springs an operating member is provided which is rotatable in opposite directions and also is vertically movable. Upon rotation of said operating member in one direction, one of said gas springs is released to permit pivotal movement of the associated holder. When said operating member is rotated in the opposite direction, the other gas spring is released to permit pivotal movement of the associated holder. When the operating member is raised, both gas springs are released to permit simultaneous pivotal movement of the back-rest and the seat.

6 Claims, 2 Drawing Sheets

SEAT MOUNTING FOR OFFICE CHAIRS

BACKGROUND OF THE INVENTION

Many people, in particular office workers, spend a considerable part of their working hours sitting down. Physicians and ergonomics specialists have found that a wrong sitting posture is a primary source of backache complaints and that a person who spends many hours leaning over a table subjects the muscles of his back to considerable strain. For this reason, it is important that the chair is designed correctly and adjustable to satisfy the user's requirements in order to give optimal support to his posterior and back in all sitting postures.

Office chairs normally comprise a seat on a base-mounted central column which is vertically adjustable for setting the seat height, a back-rest which also is vertically adjustabnle and tiltable backwards from a resiliently restraining forward position, and a mounting on the lower side of the seat, by means of which the seat is connected with the central column and the back-rest via a back-rest support secured to the back-rest. The mounting also comprises the operating levers or the like for the different seat and back-rest movements.

To enable optimal adjustment of the seat and the back-rest, the operating levers must be easily operable and readily accessible. Presentday adjustment means often have a stepwise function, which is a disadvantage because they do not permit exact and individual adaptation of the seat and the back-rest to the user's requirements, or at least make such an adaptation more difficult. In addition, the adjusting means sometimes are unnecessarily complicated, which makes the construction more expensive and more susceptible to functional trouble. The arrangement of one operating lever for each seat and back-rest movement is less suitable because this means that the levers must be operated alternately in order to obtain the desired seat and back-rest positions, and as a result the final position frequently will be more or less a compromise.

SUMMARY OF THE INVENTION

The present invention relates to a seat mounting, especially for an office chair with base, central column, seat and back-rest, comprising a frame with attachments to be secured to the lower side of the seat, pivotal holders in said frame for said back-rest and said central column, means between said frame and said holders for counteracting pivotal movement, and an operating member movable against the action of a spring force from a neutral position in at least three directions, said operating member being mounted in said frame and adapted, upon movement in a first and a second direction, to release either one of said means counteracting pivotal movement so that it permits pivotal movement of the associated holder and, upon movement in said third direction, to release both means simultaneously.

It is the object of this invention to provide a simple mounting of the above-mentioned type which permits continuously variable adjustment of the seat and the back-rest, in which the operating mechanism is simple and reliable, and the important adjustment of the seat tilt can be effected simultaneously with the adjustment of the back-rest tilt.

BRIEF DESCRIPTION OF DRAWINGS

The invention will be described in more detail below, reference being had to the accompanying drawings in which.

DESCRIPTION OF THE PREFERRED EMBODIMENT

Figure 1:
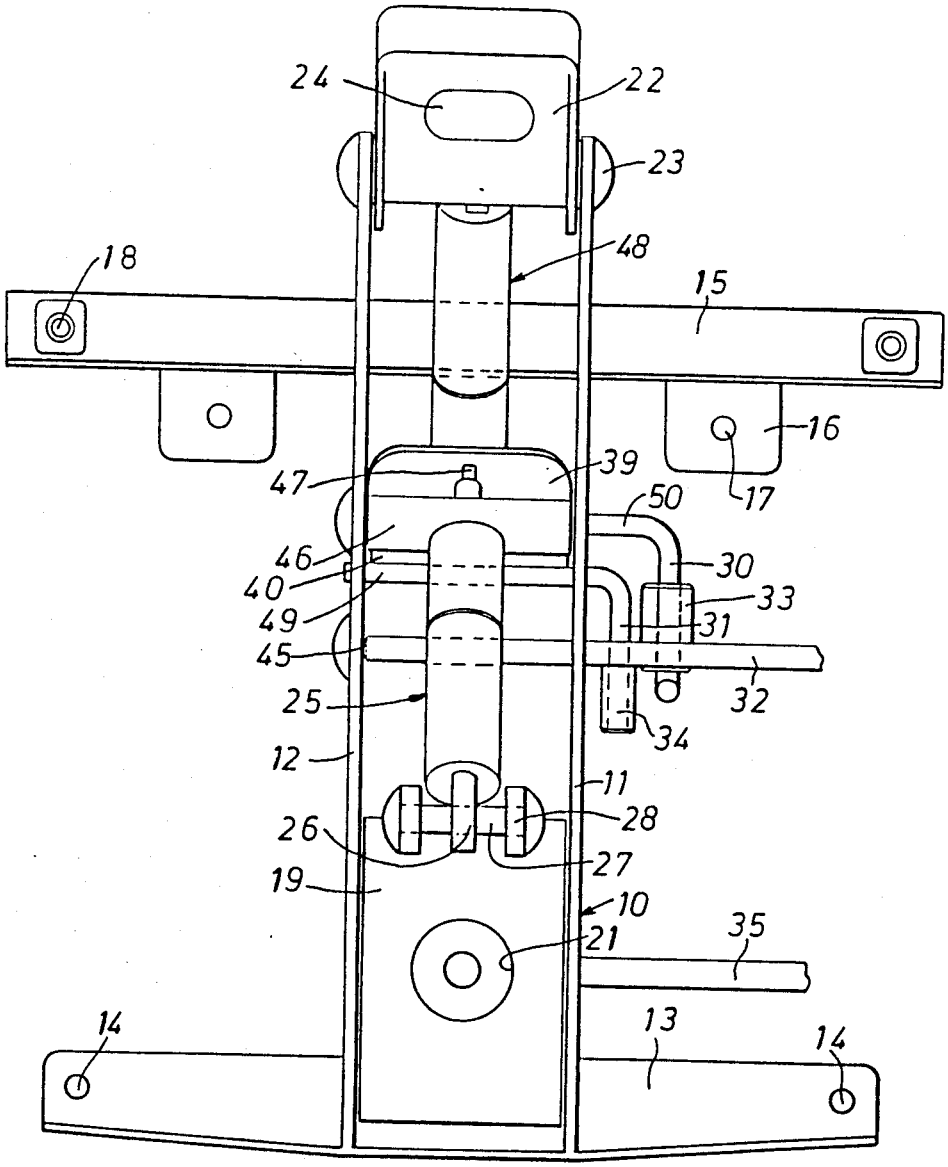
FIG. 1 shows a seat mounting according to the invention as seen from below.

The seat mounting according to the invention comprises a frame generally designated 10 and having two frame side members 11, 12 spaced apart by means of frame cross members 13, 15. One cross member 13 is arranged at one short end of the frame and is in the form of an L-section, one flange of which engages the upper side of the side members 11, 12, while the other flange has the same height as the side members 11, 12 and engages the end edges thereof. The cross member 13 is secured to the side members 11, 12 by welding and, as shown in FIG. 1, projects a considerable distance from the outwardly facing surfaces of the side members 11, 12 and has at each end a bore 14. The other cross member 15 is in the form of a square tube mounted in shallow recesses in the upper side of the side members 11, 12 and extending, like the cross member 13, perpendicularly to the side members 11, 12. Attachment lugs 16 are welded to the square tube 15 and provided each with one bore 17. At each end, the square tube 15 has a bore 18. The cross members 13, 15 form attachments for securing the frame 10 to the lower side of the seat by means of screws passed through the bores 14, 17 and/or 18 and screwed into the seat. The frame 10 is secured such to the seat lower side that the longitudinal center line of the frame 10 coincides with the seat center line which extends from the front edge to the rear edge of the seat, the cross member 15 being arranged adjacent the rear seat edge.

Figure 2:
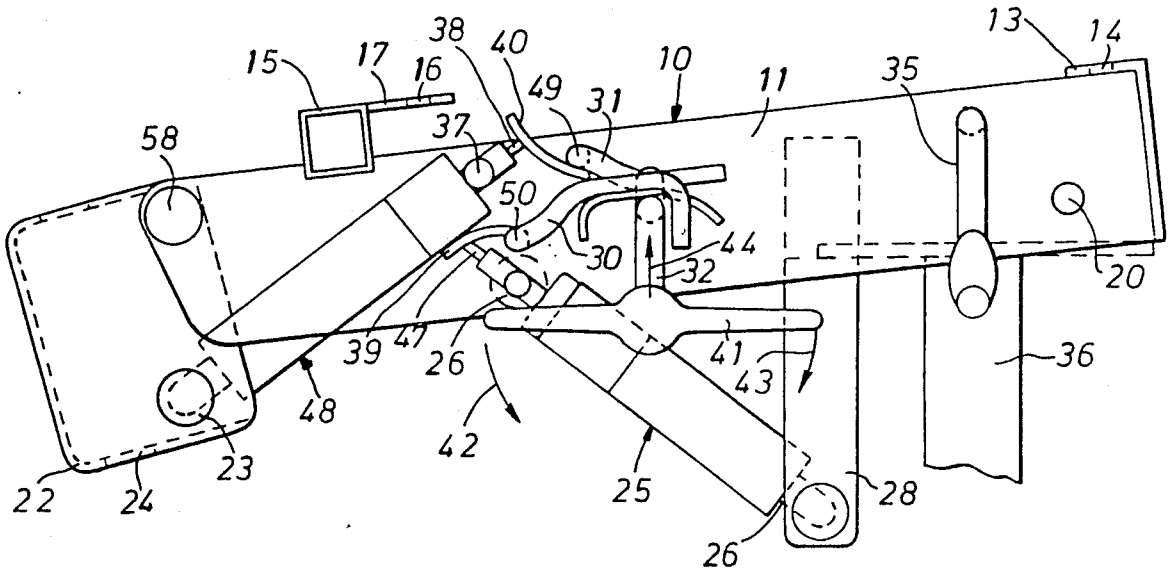
FIG. 2 shows the seat mounting from one side.

At the front end of the frame 10, a holder 19 is mounted vertically pivotably on a pivot pin 20 (FIG. 2). The holder 19 has a throughhole 21 which may be formed by a tubular member welded in the holder 19. The throughhole 21 serves to accommodate in conventional manner the upper end of a base-mounted support column 36 comprising a gas spring for extending and shortening the support column for adjustment of the seat height. The operating means of the gas spring lies slightly above the upwardly facing surface of the holder 19 and is actuated by means of a lever 35 of conventional design. At the opposite end of the frame 10, another holder 22 is pivotally mounted on a pin 23 and is adapted to accommodate, in an opening 24, the back-seat support. The holder has a manually operable member (not shown) for holding the back-rest support in the adjusted vertical position.

The pivotal mounting of the two holders 19, 22 makes it possible to tilt the frame 10, and thus the chair seat, in relation to the vertical support column 36, and to tilt the back-rest in relation to the chair seat. To maintain the seat and the back-rest in the adjusted tilted position, the holder 19 is connected to the frame 10 by means of a gas spring 25, and the holder 22 is connected to the frame 10 by means of a gas spring 48. These gas springs 25, 48 are of conventional design, which means that they have at one end an actuating means, such as the one designated 47 in FIG. 1 which on actuation released the gas spring and provides for relative movement of the two ends of the gas spring. Gas springs are very common in the context and operate satisfactorily. However, it should be stressed that other means which counteract pivotal movement of the holders 19, 22 and are actuated to permit pivotal movement, are also conceivable in the context. The gas spring 25 has at one end an attachment lug 26 through which a shaft 27 extends. The shaft 27 is pivotally mounted between the ends of two fastening means 28 (FIG. 2) which are connected to the holder 19. The opposite end of the gas spring 25, which is movable relative to the end attached by means of the lug 26, is connected to a member 46 mounted between the side members 11, 12. The actuating means 47 of the gas spring 25 projects from the opposite side of the member 46, as will appear from FIG. 1. The gas spring 48 is pivotally connected to the holder 22 by means of a pivot pin 23 located at a distance from the pivot pin 58 of the holder 22 between the side members 11, 12. The opposite end of the gas spring 48, which is movable relative to the first-mentioned mentioned spring end, is mounted at 37 in the same manner as the gas spring 25, and its actuating member 38 projects from the side of the bearing site facing away from the gas spring 48.

Of essential importance to the chair function is the simple and convenient manner in which the two gas springs 25, 48 can be actuated, i.e. released and then relocked after they have been displaced to the desired extent. To this end, two shafts 49, 50 extending transversely of the frame are rotatably mounted in apertures located opposite one another in the side members 11, 12. As is best seen from FIG. 2, each shaft has an arcuate lug 40 and 39, respectively, located closely adjacent the respective actuating members 38, 47 of the gas springs. The spring ends which are provided with the actuating members, and the shafts 49, 50 are so located in the frame 10 that the actuating members 47, 38 of the gas springs 25 and 48, respectively, hold the shafts 50, 49 in a first position-by actuation of the lugs 39, 40 of the shafts 50, 49, in which position the gas springs 25, 48 lock the movement of the seat and the back-rest. To enable the seat and the back-rest to be tilted, the shafts 49, 50 must be rotated such that the lugs 40, 39 exert pressure on the actuating members 38, 49. The shafts 49, 50 are rotated by means of angled portions 31 and 30, respectively, of these shafts. The angled portions 30, 31 are engaged by arcuate actuating lugs 33 and 34, respectively, mounted on a shaft 32 in the side members 11, 12 of the frame 10. In the embodiment illustrated, the angled portions 31, 30 of the shafts 49, 50 lie on the outside of one frame side member 11, but may also be disposed within the frame. The shaft 32 extends through a transverse slot in the frame side member 11, said slot being vertical in the position of use, and is rotatable at 45 and slightly tiltably mounted in the side frame member 12. The end of the shaft 32 facing away from the frame 10 carries a control handle 41 which, after the seat mounting has been attached to the lower side of the seat, is located adjacent one side edge of said seat.

By the arrangement described above, the gas springs can be operated in a simple and highly convenient manner. As will appear from FIG. 1, the arcuate lugs 33, 34 on the shaft 32 project in opposite directions, and if the control handle 41 is rotated clockwise, as shown by the arrow 43, the lug 33 will swing the angled portion 30 of the shaft 50 upwards, whereby the shaft 50 is rotated and the lug 39 exerts pressure upon the actuating member 47 so that the gas spring 25 is released and the seat can be pivoted relative to the support column. When the desired seat tilt has been achieved, the handle 41 is released, and the spring action returns the actuating member 47 into the position shown in FIG. 2, and the gas spring 25 maintains this position by its locking capacity. During this operation, the lug 34 projecting in the opposite direction from the shaft 32 has been raised from the associated shaft portion 31 which thus has not been actuated. If, on the other hand, the control handle 41 is rotated counterclockwise, as shown by the arrow 42, the last-mentioned shaft portion 31 is actuated, whereby the shaft 49 is rotated and the spring 48 is released in that the lug 40 exerts a pressure upon the actuating member 38 of this gas spring so that the holder 22 and thus the back-rest can be tilted. For the same reason as above, the shaft portion 30 is not actuated. The gas spring 48 again exerts its locking action when the handle 41 is released. Since the sahft 32 is mounted in a slot in the side member 11, the handle can also be raised, as indicated by the arrow 44 and then both shafts 49, 50 are actuated in that the lugs 33, 34 urge the angled shaft portions 30, 31 upwardly, whereby both gas springs 25, 48 are released and the tilt of the seat can be adjusted simultaneously with the tilt of the back-rest. In this manner, the desired seat and back-rest positions are readily adjustable. The continuously variable adjustability of both the seat and the back-rest into the desired tilted position, enables the user of the chair to select a position which exactly corresponds to his requirements.

I claim:

1. Seat mounting, especially for an office chair, with base, central support column, seat and back-rest, comprising a frame adapted to be secured to the lower side of a seat, a first holder pivotally attached to said frame and attached to said central support column, a second holder pivotally attached to said frame and adapted for attachment to a back-rest spring means connected between said frame and said first and second holders for counteracting pivotal movement between said holders and said frame, and a control means for movement against the action of a spring force from a neutral position in at least three directions, said control means being mounted in said frame for movement comprising a first and a second direction, to release said spring means counteracting pivotal movement so that pivotal movement of an associated holder is permitted and, a third direction, to release both holders for pivotal movement simultaneously.

2. A seat mounting as claimed in claim 1, wherein said control means is rotatable in opposite directions and vertically pivotal from the neutral position.

3. A seat mounting as claimed in claim 1, wherein said frame includes a pair of side members and said control means comprises a shaft, one end of which is mounted in one frame side member and which extends therefrom through a vertical slot in the opposite frame side member to a location which, when said frame has been secured to the lower side of the seat, lies underneath a seat edge where an opposite end of said shaft has a readily accessible handle.

4. A seat mounting as claimed in claim 3, wherein said spring means includes at least two springs and said shaft of said control means has two lugs, one of which is adapted to engage an angled portion on a first actuating shaft coupled to one of said springs counteracting pivotal movement for actuation thereof when the handle is rotated in one direction, while the other lug is adapted to engage an angled portion on a second actuating shaft coupled to another one of said springs counteracting pivotal movement for actuation thereof upon rotation of the handle in the opposite direction, and which lugs are adapted to actuate both angled portions when said shaft is moved from one end of the slot to the other.

5. A seat mounting as claimed in claim 4, wherein said two springs counteracting pivotal movement are gas springs, and said actuating shafts are mounted in the frame parallel to said control means shaft and are provided each with one perpendicular portion adjacent said lugs of said control means shaft, said lugs secured after one another in the axial direction and projecting each in one direction approximately radially from said control means shaft, and wherein said actuating shafts are provided each with one radially projecting lug adapted, upon rotation of the shaft, to exert pressure on a release pin of an associated one of said gas springs.

6. A seat mounting for a chair having a base, a central column, a seat and a back-rest, comprising:

a frame including a pair of spaced apart side members attached to a pair of cross members, said cross members adapted to be attached to a chair seat;

a first holder pivotally attached to said frame and attached to a central support column having a base;

a second holder pivotally attached to said frame and adapted to be attached to a back-rest;

a first gas spring means attached to said frame at one end and pivotally attached to said first holder at an opposite end for counteracting pivotal movement between said first holder and said frame and including a first actuating member;

a second gas spring means attached to said frame at one end and pivotally attached to sad second holder at an opposite end for counteracting pivotal movement between said second holder and said frame and including a second actuating member; and control means mounted on said frame and movable in at least three directions with respect to said frame, whereby upon movement of said control means in a frist direction said first actuating member is actuated to permit movement of said first holder, upon movement of said control means in a second direction said second actuating member is actuated to permit movement of said second holder, and upon movement of said control means in a third direction said first and second actuating members are actuated to permit movement of said first holder and said second holder simultaneously.

* * * * *